US007175568B2

(12) United States Patent
Eschenbach

(10) Patent No.: US 7,175,568 B2
(45) Date of Patent: Feb. 13, 2007

(54) ELLIPTICAL EXERCISE APPARATUS WITH ARTICULATING TRACK

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 33 days.

(21) Appl. No.: 11/180,876

(22) Filed: Jul. 14, 2005

(65) Prior Publication Data

US 2007/0015632 A1 Jan. 18, 2007

(51) Int. Cl.
*A63B 22/04* (2006.01)
*A63B 69/16* (2006.01)

(52) U.S. Cl. ..... 482/52; 482/57

(58) Field of Classification Search ..... 482/51–52, 482/57, 70, 79–80

See application file for complete search history.

(56) References Cited

U.S. PATENT DOCUMENTS 5,518,473 A * 5/1996 Miller ..... 482/57
5,562,574 A * 10/1996 Miller ..... 482/51
5,573,480 A * 11/1996 Rodgers, Jr. ..... 482/57
5,577,985 A * 11/1996 Miller ..... 482/52
5,997,445 A 12/1999 Maresh et al. ..... 482/70
6,024,676 A 2/2000 Eschenbach ..... 482/51
6,168,552 B1 1/2001 Eschenbach ..... 482/52
6,436,007 B1 8/2002 Eschenbach ..... 482/52
6,440,042 B2 8/2002 Eschenbach ..... 482/52
6,629,909 B1 10/2003 Stearns et al. ..... 482/52
6,648,800 B2 11/2003 Stearns et al. ..... 482/52

* cited by examiner

*Primary Examiner*—Stephen R. Crow
(74) *Attorney, Agent, or Firm*—Paul W. Eschenbach

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet. Elliptical cross trainers guide the feet along a generally elliptical shaped curve to simulate the motions of jogging and climbing. Existing elliptical cross trainers often use excessive pedal articulation which can overwork the ankle to achieve a longer stride. The present invention is an improved elliptical exercise machine capable of extended exercise with less pedal articulation that is more ankle friendly. One end of a foot support member has a pedal which follows elliptical motion while the other end is guided by a rocker link. A guide track moves up and down in rollable contact with the pedal to drive an alternator and flywheel. The resulting pedal motion is foot friendly. Handles are coordinated with the foot support members for arm exercise.

20 Claims, 2 Drawing Sheets

ELLIPTICAL EXERCISE APPARATUS WITH ARTICULATING TRACK

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet. The elliptical path is provided by a pedal in rolling contact with an articulating track.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for an elliptical exercise machine capable of a similar long stride using a crank-rocker linkage to modify a shorter crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Eschenbach in U.S. Pat. No. 6,436,007 shows the use of a crank linkage in a front drive elliptical design. Maresh et al. in U.S. Pat. No. 5,997,445 shows elliptical exercise with an adjustable track supporting a roller positioned midway along the foot support member. Eschenbach in U.S. Pat. No. 6,168,552 also shows elliptical exercise with an adjustable track with a roller positioned intermediate the ends of a foot support member with arm exercise added. Eschenbach in U.S. Pat. No. 6,440,042 offers elliptical exercise having adjustable stride and adjustable ellipse orientation.

Stearns et al. in U.S. Pat. Nos. 6,629,909 and 6,648,800 show a rotary track with a pedal able to reciprocate upon the track with the same angular movement during ellipse generation. Eschenbach in U.S. Pat. No. 6,024,676 shows a moving track in rollable contact with a pedal that has a different angular movement than the track.

There is a need for a pedal operated exercise machine that can be safely operated in the standup position whereby the arms and legs can be exercised with the feet moving through a generally elliptical movement without excessive pedal articulation.

It is one objective of this invention to provide an elliptical pedal movement with a linkage that provides a long stride with less pedal articulation. Excessive pedal articulation causes ankle stress. Another object of this invention is to use a moving track to provide the pedal lift. Another object of this invention is to provide arm exercise that is coordinated with the pedal movement.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an elongate curve motion while pedal angles vary during the pedal cycle to maintain the heel of the foot in contact with the pedal with less pedal articulation. As the foot is raised, the heel of the foot remains generally in contact with the inclining pedal for safer operation. Arm exercise is by arm levers coordinated with the mechanism guiding the foot pedals.

In the preferred embodiment, the apparatus includes a separate pedal for each foot, each pedal being positioned at one end of a foot support member and partially supported by a crank-rocker linkage at the first portion of the foot support member. The crank-rocker linkage has a rotary crank arm which completes one full revolution during a pedal cycle and is phased generally opposite the crank arm for the other pedal through a crankshaft pivot axis attached to the framework. A rocker link is connected at a rocker pivot to the framework. A coupler link is connected to the crank at a crank arm pivot and the rocker link is connected to the coupler link at a pivot to form a crank-rocker mechanism where the rocker link oscillates about the rocker pivot when the crank rotates. The rocker link is pivotally connected to the first portion of the foot support member.

A second portion of the foot support member is supported by a roller positioned under the foot support member and in rollable contact with a guide track. The guide track is supported on each end with a pair of guide links proportioned to cause the guide track to move up and down with generally parallel motion. A connecting link is pivotally connected to the coupler link and one of the guide links causing the guide links to oscillate when the crank rotates. A tie rod connects the pair of guide links having tie rod pivots positioned generally perpendicular to the guide track. As the crank arms are driven by foot motion, the pedals follow an elongate curve path approximating an ellipse having less pedal articulation than other elliptical cross trainers having long crank arms.

Arm exercise is provided with handles pivotally connected to the framework and coordinated with the rocker links. When the foot is forward, the handle corresponding to that foot is generally rearward.

Load resistance is imposed upon the crank arms through pulleys and belts from a flywheel and alternator. A control system regulates the load on the alternator to vary the resistance to exercise. The resistance can be varied during operation through a control system within easy reach of the operator. Other forms of load resistance such as friction, magnetic, air, belt, etc. may also be used.

In summary, this invention provides the operator with stable foot pedal support having motions that simulate running, climbing and cycling with very low joint impact and upper body exercise. The pedal motion exhibits a long stride with less pedal articulation common to other elliptical trainers for less ankle stress.

DETAILED DESCRIPTION OF THE EMBODIMENTS

Figure 1:
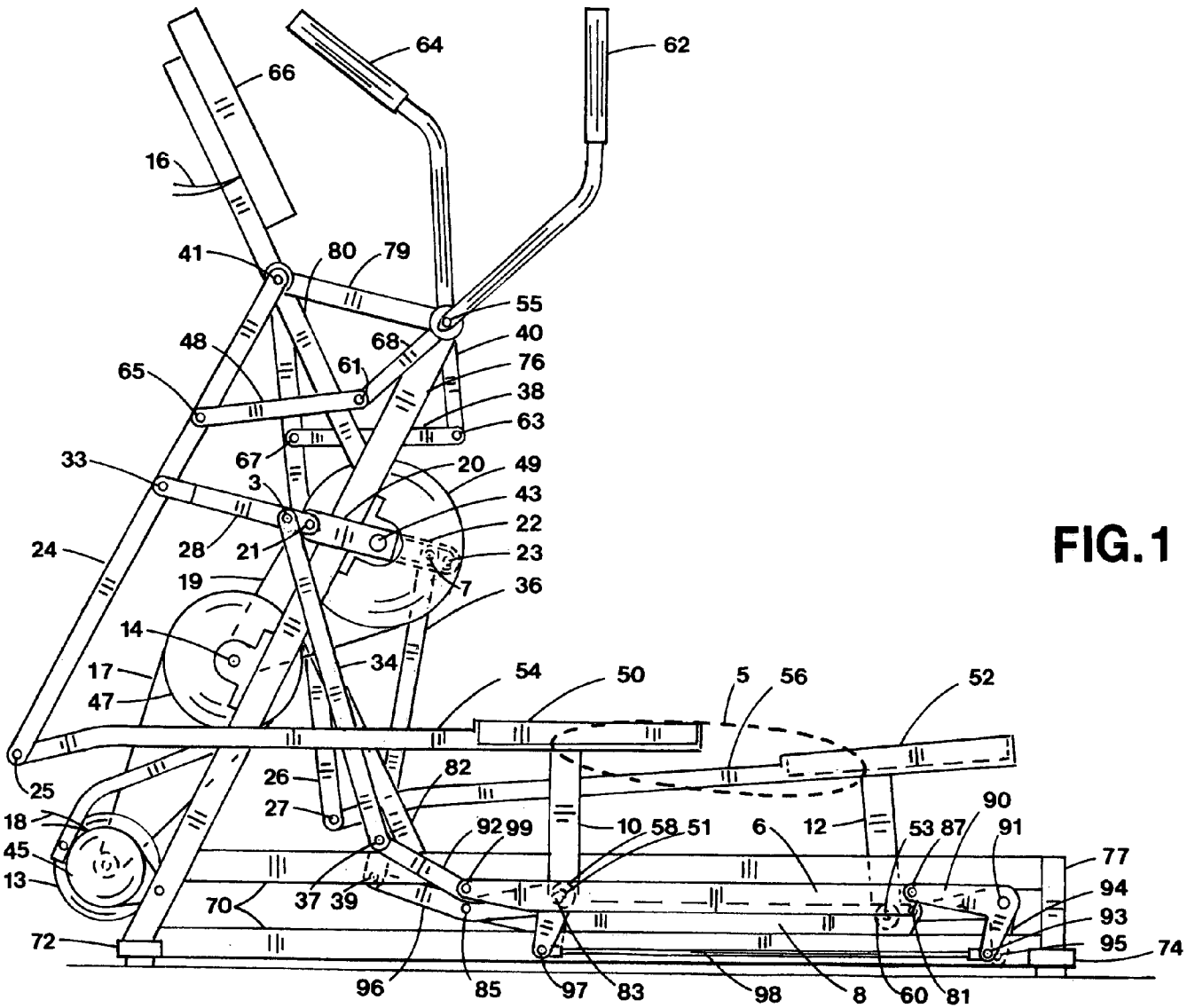
FIG. 1 is a right side elevation view of the preferred embodiment of an exercise machine constructed in accordance with the present invention.
Figure 2:
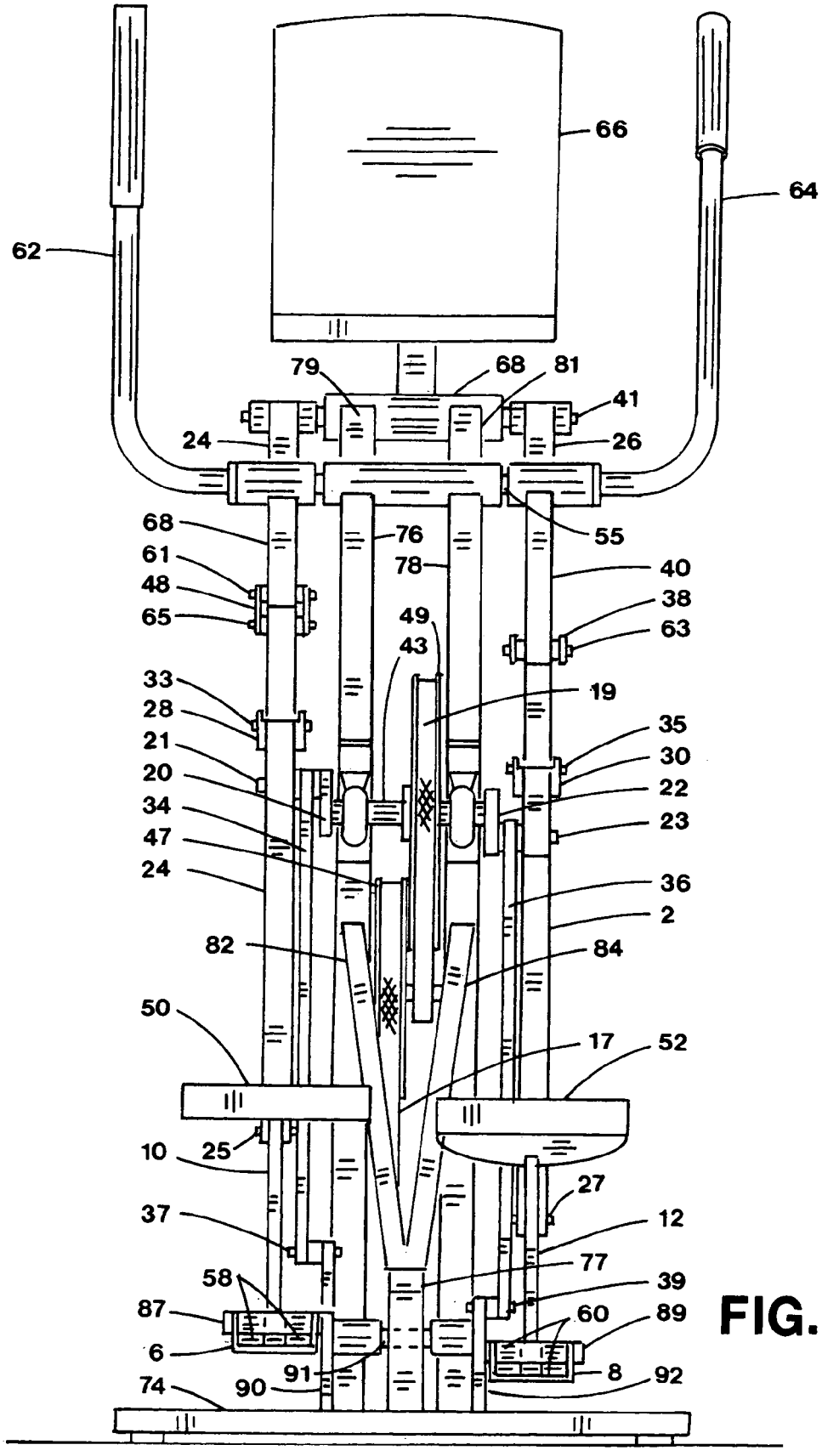
FIG. 2 is the rear view of the preferred embodiment shown in FIG. 1.

Referring to the drawings in detail, pedals 50 and 52 are shown in FIGS. 1 and 2 in the most forward and rearward positions of the preferred embodiment. Pedals 50 and 52 are supported by foot support members 54 and 56 and traverse an elongate closed loop path 5. Foot support members 54,56 are connected to rocker links 24,26 at pivots 25,27 and supported by rollers 58,60 positioned under the foot support members 54,56 at pivots 51,53 located on foot support extensions 10,12. Rollers 58,60 are in rollable contact with guide tracks 6,8.

Crank arms 20,22 are joined as generally opposed at pivot axis 43 to form a crank. Rocker links 24,26 are connected to the framework 79,80 at pivot 41. Coupler links 28,30 are connected to crank arm pivots 21,23 at one end and to rockers 24,26 at the other end with pivots 33,35.

Guide tracks 6,8 support rollers 58,60 which roll back and forth on guide tracks 6,8 as the guide tracks 6,8 move up and down. A pair of rear guide links 90,94 are pivotally connected to frame member 70 at pivot 91 and to the rear portion of guide tracks 6,8 at pivots at 87,81. A pair of forward guide links 92,96 are pivotally connected to frame member 70 at pivot 83 and to the forward portion of guide tracks 6,8 at pivots 99,85. Tie rod 98 is connected to forward guide link 92 at pivot 97 and to rear guide link 90 at pivot 93. Pivots 97,93 are positioned on the forward and rear guide links 92,90 generally perpendicular to a line through pivots 85,83 and 87,91. Similarly, tie rod 102 (not shown) is connected to forward guide link 92 at pivot 103 (not shown) and to rear guide link 94 at pivot 95.

Guide track 6 moves up and down with generally parallel motion when the distance between pivots 99,83 on the forward guide link 92 is generally the same as the distance between pivots 87,91 on the rear guide link 90. Further, the distance between pivots 97,83 on the forward guide link 92 is generally the same as the distance between pivots 93,91 on rear guide link 90 to assure that tie rod 98 also moves with generally parallel motion. Guide track 8 and tie rod 102 operate with similar movement.

Connector links 34,36 are connected to coupler links 28,30 at pivots 3,7 and to extensions of forward guide links 92,96 at pivots 37,39. As crank arms 20,22 rotate, coupler links 28,30 orbit to cause forward guide links 92,96 and rear guide links 90,94 to oscillate with a resulting up and down movement of guide tracks 6,8. Tie rods 98,102 are always in tension during operation of the exercise apparatus.

As the weight of the operator impinges upon pedal 50 in the forward position, guide track 6 moves downward resulting in a counterclockwise rotation of forward guide link 92 about pivot 83. Pivot 37 on the extension of guide link 92 pulls connector link 34 downward with a resulting counterclockwise rotation of crank arm 20 about pivot 43. As coupler link 28 moves downward, rocker link 24 moves rearward to cause foot support member 54 with pedal 50 to move rearward. The combination of rocker link 24 moving rearward and guide track 6 moving downward at the same time allows pedal 50 to initiate pedal curve 5 and for pedal 50 to articulate with rotation as it follows pedal path 5. Pedal 52 is guided along pedal path 5 in a similar manner but beginning in a rear position when pedal 50 is forward.

Handles 62,64 are connected to frame member 68 at pivot 55 for arm exercise. Handle links 68,40 are attached to handles 62,64 and connected to handle connector links 48,38 at pivots 61,63. Handle connector links 48,38 are connected to rocker links 24,26 at pivots 65,67.

Pulley 49 is attached to crank arms 20,22 and rotates about pivot axis 43 to drive alternator 45 and flywheel 13 through belts 17,19 and step-up pulley 47. Alternator 45 is supported by frame members 76,78 and is connected to controller 66 by wires 16,18 using conventional wiring (not shown). Controller 66 is attached to frame member 68 and works with alternator 45 to provide variable resistance to exercise using conventional methods.

Crank pivot axis 43 is supported by frame members 76,78 which are attached to frame members 70. Cross members 72,74 are supported by the floor and attach to frame members 70. Pulley 47 is supported at pivot 14 which is attached to frame members 76,78. Frame member 68 is attached to frame members 76,78 to support handle pivot 55. Frame members 79,80 are attached to frame members 76,78 to support rocker pivot 41.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of rocker links, each said rocker link configured to oscillate about a rocker pivot;

a pair of coupler links, each said coupler link pivotally connected to said crank and a corresponding said rocker link;

said rocker links pivotally connected to said first portion of said foot support members to control back and forth movement of said pedals;

a pair of forward guide links, each said forward guide link pivotally connected to said framework;

a pair of rear guide links, each said rear guide link pivotally connected to said framework;

a pair of guide tracks, each said guide track pivotally connected to corresponding said forward and rear guide links;

a pair of connector links, each said connector link pivotally connected to said coupler link and said forward guide link;

a pair of rollers, each said roller positioned in said second portion of said foot support member and in rollable contact with a corresponding said guide track to drive the up and down movement of said guide track;

said pedal configured to move relative to said framework when the foot of the user is rotating said crank whereby said pedal follows an elongate curve path.

2. The exercise machine according to claim 1 wherein said elongate curve path is generally elliptical in shape.

3. The exercise machine according to claim 1 further comprising arm exercise levers, said arm exercise levers operably associated with said crank.

4. The exercise machine according to claim 3 wherein said arm exercise levers further comprises a pair of handles, each said handle pivotally connected to said framework.

5. The exercise machine according to claim 1 further comprising a flywheel, said flywheel rotatably connected to said framework and operably associated with said crank.

6. The exercise machine according to claim 5 further comprising a load resistance, said load resistance operably associated with said flywheel, a means for adjustment of said load resistance and, a control system, said control system positioned within reach of the operator whereby said load resistance can be varied during operation of said exercise machine.

7. The exercise machine according to claim 1 further comprising a pair of tie rods, each said tie rod connected to corresponding said forward and rear guide links with pivots positioned generally perpendicular to a corresponding said guide track.

8. The exercise machine according to claim 7 wherein each said tie rod moves with parallel motion during operation of said exercise machine.

9. The exercise machine according to claim 1 wherein said guide tracks move with parallel motion during operation of said exercise machine.

10. The exercise machine according to claim 1 wherein each said pedal articulates with non-parallel angular motion during operation of said exercise machine.

11. The exercise machine according to claim 1 wherein each said second portion of said foot support member extends downward to support said roller.

12. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of rocker links, each said rocker link configured to oscillate about a rocker pivot;

a pair of coupler links, each said coupler link pivotally connected to said crank and a corresponding said rocker link;

said rocker links pivotally connected to said first portion of said foot support members to control back and forth movement of said pedals;

a pair of forward guide links, each said forward guide link pivotally connected to said framework;

a pair of rear guide links, each said guide rear link pivotally connected to said framework;

a pair of guide tracks, each said guide track pivotally connected to corresponding said forward and rear guide links;

a pair of connector links, each said connector link pivotally connected to said coupler link and said forward guide link;

a pair of rollers, each said roller positioned in said second portion of said foot support member in rollable contact with a corresponding said guide track to drive the up and down movement of said guide track;

a pair of tie rods, each tie rod pivotally connected to a corresponding forward and rear guide link;

said pedal configured to move relative to said framework when the foot of the user is rotating said crank whereby said pedal follows an elongate curve path with non-parallel angular movement.

13. The exercise machine according to claim 12 further comprising a load resistance, said load resistance operably associated with said crank, a means for adjustment of said load resistance and, a control system, said control system positioned within reach of the operator whereby said load resistance can be varied during operation of said exercise machine.

14. The exercise machine according to claim 12 further comprising arm exercise levers, said arm exercise levers operably associated with said rocker links.

15. The exercise machine according to claim 12 wherein said guide tracks move with parallel motion during operation of said exercise machine.

16. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of crank-rocker linkages, each crank-rocker linkage configured to include said crank and a rocker link pivotally connected to said first portion of said foot support member to control back and forth movement of said pedal;

a pair of forward guide links, each said guide forward link pivotally connected to said framework;

a pair of rear guide links, each said guide rear link pivotally connected to said framework;

a pair of guide tracks, each said guide track pivotally connected to corresponding said forward and rear guide links;

a pair of connector links, each said connector link operably associated with said crank-rocker linkage and pivotally connected to a corresponding said forward guide link;

a pair of rollers, each said roller positioned in said second portion of said foot support member in rollable contact with a corresponding said guide track to drive the up and down movement of said guide track;

a pair of tie rods, each tie rod connected to a corresponding forward and rear guide link with pivots positioned generally perpendicular to a corresponding said guide track;

said pedal configured to move relative to said framework when the foot of the user is rotating said crank whereby said pedal follows an elongate curve path.

17. The exercise machine according to claim 16 further comprising handles operably associated with said crank-rocker linkages.

18. The exercise machine according to claim 16 further comprising a load resistance, said load resistance operably associated with said crank, a means for adjustment of said load resistance and, a control system, said control system positioned within reach of the operator whereby said load resistance can be varied during operation of said exercise machine.

19. The exercise machine according to claim 16 wherein said guide tracks move with parallel motion during operation of said exercise machine.

20. The exercise machine according to claim 16 wherein each said pedal articulates with non-parallel angular motion during operation of said exercise machine.

* * * * *